United States Patent [19]

Elonen et al.

[11] Patent Number: 4,981,413

[45] Date of Patent: Jan. 1, 1991

[54] PUMP FOR AND METHOD OF SEPARATING GAS FROM A FLUID TO BE PUMPED

[75] Inventors: Jorma Elonen, Jamsankoski; Jukka Timperi; Reijo Vesala, both of Kotka; Vesa Vikman, Kymi, all of Finland

[73] Assignee: Ahlstrom Corporation, Noormarkku, Finland

[21] Appl. No.: 344,306

[22] Filed: Apr. 27, 1989

[51] Int. Cl.[5] ..... F01D 5/14

[52] U.S. Cl. ..... 415/115; 415/169.1; 415/144

[58] Field of Search ..... 415/169.1, 112, 169.2, 415/106, 115, 144; 416/181; 417/68, 69

[56] References Cited

U.S. PATENT DOCUMENTS

| | | | |
|---|---|---|---|
| 1,683,633 | 9/1928 | Tait | 415/106 |
| 2,361,521 | 10/1944 | Yates | 415/106 |
| 2,611,322 | 9/1952 | Wahle | 415/106 |
| 3,280,750 | 10/1966 | White | 415/169.1 |
| 3,663,117 | 5/1972 | Warren | 415/106 |
| 4,152,092 | 5/1979 | Swearineen | 415/168.2 |
| 4,256,436 | 3/1981 | Fandrey et al. | 415/169.1 |
| 4,776,758 | 10/1988 | Gullichsen | 415/169.1 |

*Primary Examiner*—Edward K. Look

*Assistant Examiner*—Hoang Nguyen

*Attorney, Agent, or Firm*—Cohen, Pontani & Lieberman

[57] ABSTRACT

A centrifugal pump for separating an entrained gas from a working fluid in which the pump housing has a hollow chamber therein, an axially extending inlet into the chamber, an outlet leading out of the chamber, and a gas vent for the chamber; a rotatable shaft mounted in the housing in axial alignment with the inlet; an impeller is disposed in the chamber and mounted on the shaft for rotation therewith, the impeller includes a plate for dividing the chamber into a first chamber portion communicating with the inlet and outlet and a second chamber portion communicating with the vent. The plate has an aperture extending therethrough for allowing the passing of working fluid and gas therethrough; and is further provided with at least one pumping vane disposed in the chamber portion for pumping the working fluid into the first chamber portion through the inlet and out of the first chamber portion through the outlet. The second chamber portion is partitioned into a plurality of spaces by a plurality of back vanes secured to the plate and a liquid rotatable within the second chamber portion upon the impeller rotating whereby to create pressure differences in the spaces for removing gas in the second chamber portion through the vent.

22 Claims, 6 Drawing Sheets

FIG. 2d
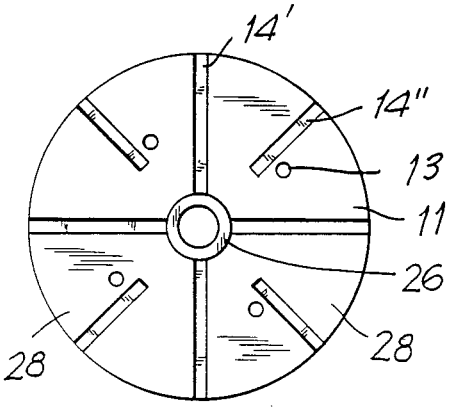
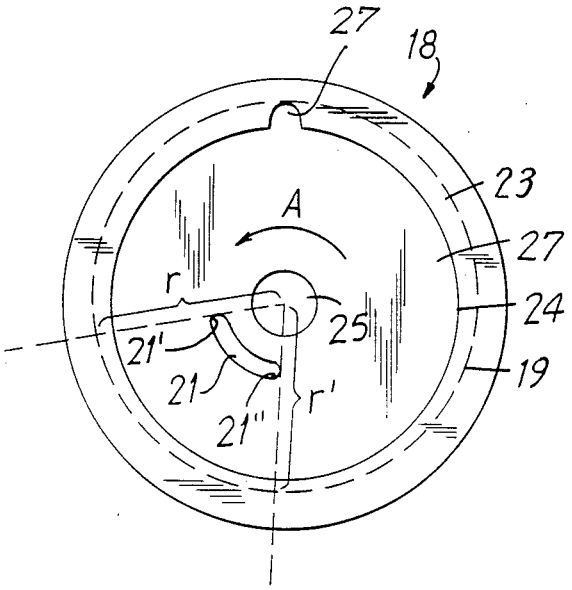
FIG. 2e

PUMP FOR AND METHOD OF SEPARATING GAS FROM A FLUID TO BE PUMPED

FIELD OF THE INVENTION

The present invention relates to a pump for and a method of separating gas from a fluid to be pumped. More specifically, the invention relates to an apparatus for removing gas in connection with a centrifugal pump used for pumping of a fluid containing gas. The pump according to the invention is especially suitable for pumping fiber suspensions of medium and high consistency of the pulp and paper industry.

BACKGROUND AND SUMMARY OF THE INVENTION

There are several known methods and apparatus for pumping high consistency pulp. Previously only displacement pumps, such as screw pumps or like, were used to pump high consistency pulp. Nowadays there is a tendency to replace the displacement pumps because of their inherent deficiencies and drawbacks. One of the first problems encountered when trying to pump pulp with the consistency of more than 8% is that the pulp does not independently flow to the impeller of the pump in the suction opening. A solution to this problem is a so-called fluidizing centrifugal pump, manufactured and sold by A. AHLSTROM CORPORATION of Karhula, Finland and by AHLSTROM PUMPS, INC. of Peace Dale, R.I. There fluidizing pumps are designed to treat medium and high consistency pulps by the action of the fluidizing rotor extending into the suction opening of the pump or in some cases through it as far as into the mass tower. By using this kind of fluidizing rotor it has been possible to pump pulp having a consistency of about 15%, which does not, however, satisfy all requirements for pulp pumping in the pulp and paper industry, as the consistency demands have risen up to about 25%.

Another difficulty in connection with the pumping of medium and high consistency pulps is that pumping of fluids containing gases, with higher gas contents, is unsuccessful without a gas discharge system because the gases collect in front of the center of the pump impeller forming a bubble which will grow thus tending to clog the entire inlet opening of the pump. This results in a considerable decrease of the yield, vibration of the equipment, and in the worst case ceasing of the pumping action altogether. This problem has been experienced in a very intense form with, for example, centrifugal pumps.

These problems have been attempted to be solved in many different ways by discharging gas from the bubble. In the equipment presently known and used, degasification is effected by either drawing gas through a pipe being disposed in the middle of the inlet channel of the pump and extending to the hub of the impeller, by drawing gas through a hollow shaft of the impeller, or by providing the impeller with one or more perforations through which the gas is drawn to the back side of the impeller and further away by some kind of a vacuum device arranged usually outside the pump.

Several different arrangements are known by means of which it has been attempted to eliminate or minimize the disadvantages or risks caused by contaminants. The simplest arrangement is a gas discharge duct which is so wide that clogging thereof is out of the question. Other methods used are, for example, arrangements with various types of vanes or vaned rotors on the back side of the impeller. A commonly used method has been to provide the immediate back surface of the impeller with radial vanes for pumping the fluid together with its contaminants. Thereby the fluid is carried with the gas through the gas discharge openings of the impeller, to the outer periphery of the impeller and through its clearance back to the liquid flow. In some cases, a similar arrangement has further been provided on the back side of the impeller with a vaned rotor mounted on the shaft of the impeller. The vaned rotor rotates in a separate chamber, being adapted to separate the liquid, which has been carried with the gas, to the outer periphery of the chamber, whereby the gas is drawn to the inner periphery thereof. The fluid accumulated at the outer periphery of the chamber is led, together with the contaminants, through a separate duct to either the inlet side or the outlet side of the pump. The gas is removed from the inner periphery by means of suitable vacuum device.

As can be seen all centrifugal pumps for pumping medium or high consistency pulps require some gas separation or discharge device which is most often arranged outside the pump as an entirely separate unit. All means described above operate satisfactorily if the amount of contaminants carried with the liquid is somewhat limited. It is also possible to adjust the pumps to operate relatively reliably with liquids containing large amounts of solids, e.g. with fiber suspensions in the pulp industry. It is known that the gas contained in the fiber suspension is a drawback in the stock preparation process. Accordingly this drawback should be avoided as much as possible. Therefore, it is a waste of existing advantages to feed the gas which has already been separated back to the stock circulation. It is also a waste of stock if, on the other hand, all stock conveyed along with the gas were separated from the stock circulation by discharging it as a secondary flow of the pump.

Another disadvantage is that when the consistency of the pulp varies the amount of gas in the pulp also varies but at a much larger scale. Since the pump has usually, for practical reasons, been adjusted to remove nearly all the gas from the pulp, in a case when the amount of gas is at its minimum, all the gas exceeding that amount will be returned to the pulp flow. In some cases when the amount of gases is expected to vary at a large scale, more than half of the gas is returned back to the circulation.

The most disadvantageous feature of nearly all of the prior art gas discharge device has, however, been the separate vacuum pump having a separate driving motor with separate installation etc. A separate vacuum pump with a drive motor has added to the costs of constructions, which has been one of the obstacles to a wider acceptance of centrifugal pumps for stock handling. The present invention, however, has rendered possible the combination of a vacuum pump with the centrifugal pump impeller for removing gas from the pump.

U.S. Pat. No. 4,776,758 discloses a centrifugal pump having fluidizing vanes in front of the centrifugal impeller and a vacuum pump arranged in a separate chamber and on the same shaft with the impeller. Thus, a separate vacuum pump and drive motor have been omitted, but the structure of the pump itself is, however, complicated as both the vacuum impeller and the centrifugal impeller have housings of their own separated by a common wall member. Thus, the impellers are entirely separate structures and the common wall has to be manufactured as a separate part for practical reasons, as one has to be able to install the vacuum impeller on the shaft. The vacuum pump used in said patent is a so-called liquid ring pump.

One object of the present invention is to simplify even further the structure of a centrifugal pump having a gas separating vacuum pump arranged therein. A characterizing feature of the pump in accordance with the present invention is the combination of the centrifugal pump impeller with the vacuum pump impeller so that the vacuum impeller is arranged on the back side of the centrifugal impeller without the necessity of a separating wall. Another feature of the apparatus in accordance with the invention is the presence of several pressure areas or spaces each with differing pressure and located behind the impeller. The differing pressure areas are provided by arranging the clearances between the impeller back plate and the impeller back vanes with respect to their opposing or counter surfaces as small as possible thereby preventing the pressurized gas/liquid/-gas containing medium from escaping therefrom. The spaces between the back vanes of the impeller are forming these differing pressure stages/areas by being sealed off as efficiently as possible by maintaining only small clearances between stationary and moving parts or by arranging the ends of the back vanes near the shaft of the pump by firmly and tightly attaching the vanes to an impeller hub portion extending substantially axially from the impeller back plate.

The advantages of the method and apparatus of the present invention are as follows:

- a separate vacuum pump and its driving motor are not needed;
- the structural changes in the pump housing are minimal compared to the known MC-pumps;
- the manufacture of a separate vacuum pump impeller has been avoided; and
- a known MC-pump can be easily converted to include the new impeller and a vacuum pump housing in accordance with the present invention.

BRIEF DESCRIPTION OF THE DRAWINGS

FIGS. 2*a–e* show the main parts of the pump in accordance with one embodiment of the present invention; for clarity the parts are shown as separate units;

DETAILED DESCRIPTION OF THE PRESENTLY PREFERRED EMBODIMENTS

Figure 1:
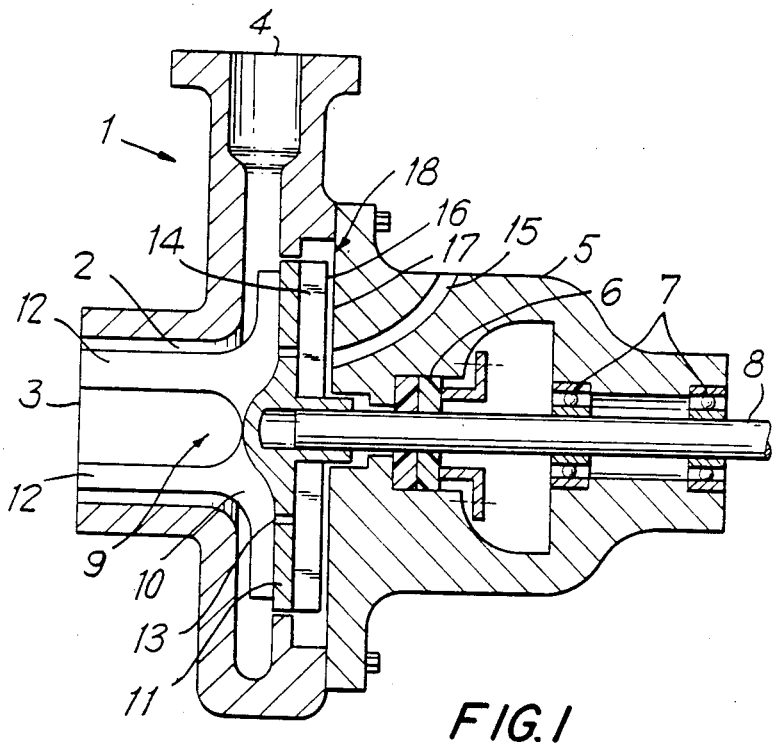
FIG. 1 is a vertical cross-sectional view of a centrifugal pump in accordance with the invention.

FIG. 1 illustrates a centrifugal pump comprising an impeller housing 1 having an inlet channel 2 with an inlet opening 3 and an outlet opening 4; a frame structure 5 having shaft sealing means 6 and two sets of bearings 7 for a shaft 8 at the end of which shaft a centrifugal impeller 9 is arranged. The pump impeller 9 is provided with at least one pumping vane 10 arranged on its backplate 11 and the pump may also be provided with one or more fluidizing blades 12 extending from the backplate 11 into inlet channel 2 of the pump. The fluidizing bade 12 may also extend through the inlet channel 3 into the pulp storage tank, drop leg or the like pulp container. The blade or blades 12 are used mainly for fluidizing the medium such as high consistency pulp and also in some cases for facilitating the separation of the gases from the pulp. However, the fluidizing blades are not necessary to the operation of the present invention. The pump impeller 9 is further provided with one or more holes or openings 13 extending through its back plate 11 for discharging the gases separated from the pulp in front of the impeller 9 to the backside of the impeller 9. The back surface of the impeller back plate 11 is provided with the vanes 14, which extend radially outwardly from the center of the impeller but which may also be curved or be located slightly inclined with respect to the radial direction thereof.

Figure 2A:
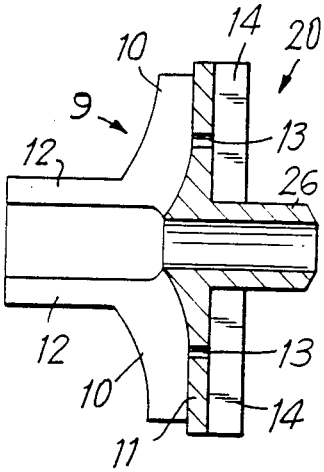
Figure 2B:
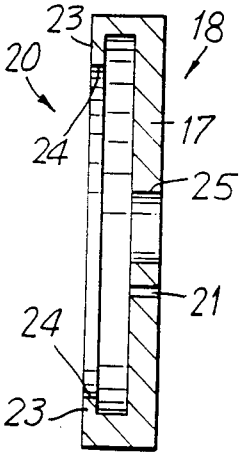
Figure 2C:
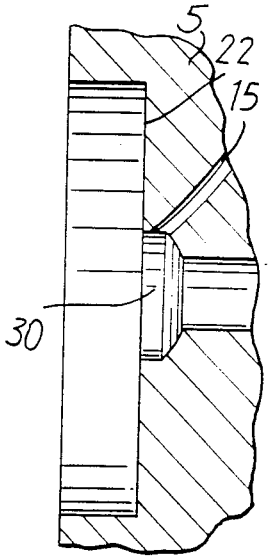
Figure 3A:
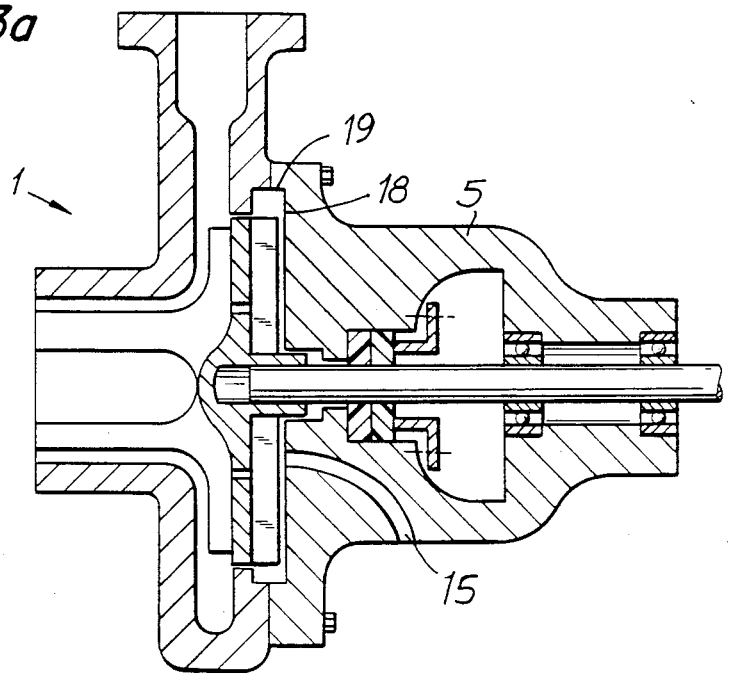
FIGS. 3*a* and *b* show two cross-sectional views of a vacuum pump structure arranged on the back side of the centrifugal pump impeller in accordance with two embodiments of the present invention.
Figure 3B:
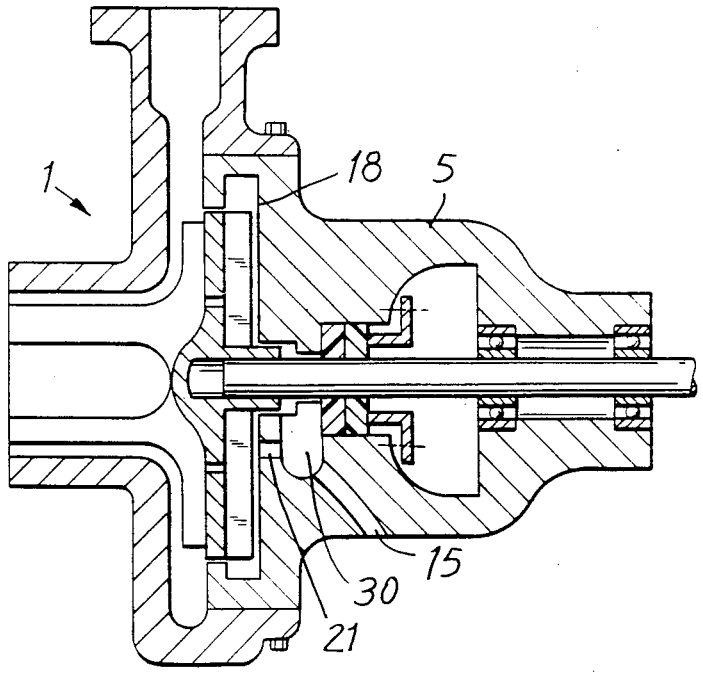

According to one embodiment of the present invention the frame structure 5 of the pump is also provided with a gas vent or discharge duct 15 originating from a chamber 16 between the pump impeller 9 and the back wall 17 of the pump. Also as shown in FIG. 1 the back vane 14 of the impeller 9 are arranged to rotate inside a housing 18. The housing 18 may be formed during the manufacturing process of the pump either as a part of the impeller housing 1 (FIG. 1), as a part of both the impeller housing and the frame structure (FIG. 3*a*), as a part of the frame structure and more precisely as a part of the back wall 17 (FIG. 3*b*) or as an entirely separate unit (FIG. 2). Though the structure of the impeller housing 1 of FIG. 1 has some superficial resemblance with a known pump in which the impeller also has back vanes, the structure and operation of the back vanes in combination with the housing 18 is entirely different. The function of the back vanes 14 in accordance with the present invention is not to pump the fiber suspension or like material back to the circulation through the clearance between the pump impeller and the pump housing like in prior art pumps, but to either remove the flow containing gases and pulp suspension from the pump as a separate flow (FIG. 4) or to act as vanes of a vacuum pump for rotating a liquid ring on the periphery of the housing 18 and, due to the eccentricity of the housing, pump the air being gathered around the shaft away from chamber 16 through duct 15 (FIGS. 1, 2 and 3). In both cases the clearance between the impeller 9 and the housing 18 is very small. The word "eccentricity" is not used in a narrow sense but in the context of this invention is understood to include not only an eccentric housing but also a housing having a cylindrical inner wall, whose center is located on the axis of the pump but whose axial dimension is longer on one side of the axis as compared to the opposite side thereof. As is further explained below in connection with FIG. 4, the above defined eccentricity may be accomplished by providing an annular groove in the back wall of the pump housing and by arranging the bottom surface of said groove in a plane which is slightly inclined with respect to the radial direction thereof.

In the preferred embodiments illustrated in FIGS. 1, 2 and 3 the back vanes 14 of the impeller 9 form the vanes of a liquid ring pump 20. The inner peripheral surface 19 of the housing 18 is eccentric in such a way that the liquid rotating there along and between the vanes 14 and forming a layer of substantially uniform thickness on the inner peripheral surface 19 of said housing 18 moves towards and away from the axis of the pump causing a vacuum and pumping effect in the chamber 16 and more precisely in each of the spaces 28 formed between the vanes 14. This eccentricity is achieved by deviating the center of the housing inner surface from the pump axis. During the vacuum stage, and while the liquid between the back vanes 14 is moving outwards, the gas collected in front of the impeller 9 is being forced through the openings 13 of the impeller as the pressure of the pulp flowing into the pump inlet and towards the impeller is higher than the pressure prevailing in the chamber 16 and between the vanes 14 located behind the impeller openings. During the pumping stage the gas collected around the axis of the chamber 16 is being forced from the pump via duct 15 as the liquid ring moves inwards towards the axis. A characteristic feature of the liquid ring pump in question is that the thickness of the liquid ring is maintained as uniform as possible, as the liquid ring has two main tasks. The first is the above explained vacuum and pumping operation while the second task is controlling the pumping of the gas. The pumping of the gas from chamber 16 is controlled as follows. Due to the liquid ring having essentially uniform radial thickness and the eccentric location of the chamber the liquid ring moves closer to the axis and covers the openings 13 in the impeller thus preventing the gases from escaping back to the front side of the impeller. Due to the operational principles of a liquid ring pump a portion of the liquid (fiber suspension) flows through the openings 13 back to the front side of the pump. In this way the thickness of the liquid ring is maintained essentially uniform. During the vacuum stage the pressure difference between opposite sides of the impeller back plate is high enough to cause a portion of the fiber suspension with the gases to flow through the openings 13 in the impeller 9 into the chamber 16. To achieve the operation described above, the openings 13 in the impeller 9 should be located further from the axis of the pump than the opening of duct 15 in the back wall 17 of the frame structure 5.

Another embodiment of the present invention is shown in FIG. *2a–2e* which describe a pump used in the tests described herein below. FIGS. *2a–2c* show the pump dismantled so that only the impeller 9 (FIG. *2a*), the housing unit 18 (FIG. *2b*) and a section of the frame structure 5 (FIG. *2c*) closest to the housing have been illustrated. The pump comprises a frame structure 5 in which there is provided a central chamber 30 around the axis for receiving gas from chamber 16 of the vacuum pump and a larger round recess 22 coaxial with the pump axis. The recess 22 is dimensioned for receiving an essentially disc shaped vacuum pump housing unit 18 which comprises a back plate 17 as part of said housing 18. The inner circumference or inner surface 19 of said housing 18 is eccentric with respect to the axis of the pump. According to a preferred embodiment the eccentricity is such that the surface itself is cylindrical but the center thereof is located at a certain distance, for instance 10 mm, from that of the pump axis, in other words, 10 mm from the center of the outer circumference of the back plate 17. The axial dimension of the surface 19 is preferably the same as the height or axial dimension of the back vanes 14 of the pump impeller 9 which rotates within the pump housing 18. The vacuum impeller housing 18 is limited from the side of the impeller 9 by a flange portion 23 projecting from the housing inner surface 19 towards the axis of the pump. The flange 23 extends towards the pump axis in such a way that the inner surface 24 of the flange 23 is coaxial with the impeller 9 of the pump. The distance of the inner surface 24 from the pump axis is slightly larger than the radius of the pump impeller back plate 11. Thus the impeller 9 with its back vanes 14 may be installed inside the housing 18 by inserting through the flange 23. The radius of the central opening 25 in the vacuum pump housing back wall 17 corresponds to the radius of the pump impeller hub portion 26 on which the back vanes 14 of the impeller 9 are mounted. Close to the central opening 25 of the back wall 17 is arranged an opening 21 for discharging gas from the chamber 16 to the chamber 30 in the frame structure, wherefrom the gas is further discharged via channel 15.

The impeller 9 is installed with respect to the vacuum pump housing 18 in such a way that the clearances between the impeller back plate 11 and back vanes 14 and their counterparts, flange surface 24 and back wall 17 are small enough to prevent undesired leakage of pulp o gases either to the pump outlet 4 or from one space 28 between the back vanes 14 to another corresponding space 28. The number of the back vanes 14 on the back plate of the impeller, illustrated in FIG. *2d*, is preferably such that there are, for instance, four long vanes 14' extending from the hub portion 26 to the outer circumference of the impeller 9 and four intermediate shorter vanes 14''. The purpose of the shorter vanes 14'' is only to assure that the liquid ring rotates sufficiently and that the thickness of the ring remains substantially constant. Of course, any number of back vanes is possible as long as the pump operates normally, a most important feature being to assure the proper working of the liquid ring. As shown the impeller is provided with a hub portion 26 extending axially from the back plate 11 of the impeller towards the sealing arrangement 6. The hub portion 26 in cooperation with sealing means 6 assure that gas will not leak from the over-pressure side of the shaft or pumping stage, to the lower-pressure side of the shaft or suction stage, as the operation of the vacuum pump depends entirely on this sealing. Thus a preferred sealing means is provided by machining a circumferential groove (not shown) into the hub portion whereby liquid fills the groove and prevents the gas from leaking. This sealing prevents also the leakage of pressure during the suction stage from space 30 behind the back wall 17 to the chamber 16.

There are, however, several other, from a manufacturing point of view more difficult solutions for providing the sealing between the impeller and the frame structure. For example, instead of the hub portion of the impeller a flange portion can be arranged which extends from the frame structure very close to the impeller so that the back vanes of the impeller are located close to the flange, whereby the sealing is provided between the stationary flange and the moving back surface of the impeller back plate and the inner edges of the back vanes of the impeller. In another embodiment the inner edges of the vanes are arranged to rest on the pump shaft thereby leaving the gap between the frame structure and the shaft as small as possible similar to the described clearance between the vanes and the back wall.

FIG. *2e* shows, as a plan view, the back wall 17 of the frame structure with the impeller and impeller housing removed. An opening 27 is provided in the flange portion 23 of the vacuum pump housing 18 for allowing some of the pulp from the liquid ring to leak back to the pulp in front of the impeller back plate. This way the amount of rotating liquid is controlled, and the thickness of the liquid ring maintained constant. Another way is to place the openings 13 in the impeller back plate 11 so that the excess pulp flows back through the openings 13. Additionally, the back wall structure 17 forms a separate unit which can be removed or changed as needed. The back wall structure belongs to the eccentric housing unit 18 of the liquid ring pump. As can be seen, there is only one opening 21 in the back wall leading to duct 15 for removing gas from the chamber 16. The opening 21 is arranged at such a location in the back wall 17 with respect to the rotation of the impeller and the eccentricity of the housing inner surface 19 that the distance between the axis of the pump and the inner peripheral surface 19 of the housing 18 decreases to its minimum r' when going in the direction of the rotation of the impeller from the first edge 21' of said opening 21 to the second edge 21" of said opening 21. The direction of the rotation of the impeller is indicated by arrow A. As shown in FIG. 2*e* the shape of the opening 21 may for instance be oblong and arcuate. The shape of the opening 21 may, however, differ greatly from the one shown in FIG. 2*e*, as the only important feature is that the opening is capable of permitting to pass all the gas flow through and away from the chamber 16.

FIGS. 3, *a* and *b* show two alternative embodiments of how to arrange the liquid ring pump housing 18 with respect to the centrifugal pump housing 1 and the frame structure 5. FIG. 3*a* shows an embodiment wherein the eccentric inner surface 19 comprises two halves, the first being provided within the centrifugal pump housing 1 and the second being provided with the frame structure 5. In FIG. 3*b*, the eccentric housing of the vacuum pump 18 is arranged entirely within the frame structure 5 of the pump, specifically within the back wall of the pump. Both FIGS. also show that the gas discharge duct 15 may also be located downwards. In FIG. 3*a* the duct 15 is connected directly with chamber 16 and to outside of the pump. In FIG. 3*b* the duct 15 starts at chamber 30 located near the shaft of the pump as described above in connection with FIG. 2*e*. In the latter arrangement it is preferred to provide an oblong gas discharge opening 21 in the back wall of the vacuum pump. However it is to be noted that there are several other methods for arranging the vacuum pump housing in connection with the centrifugal pump. In one embodiment, for example, the eccentric housing 18 is located entirely within the housing 1 of the centrifugal impeller.

Figure 4A:
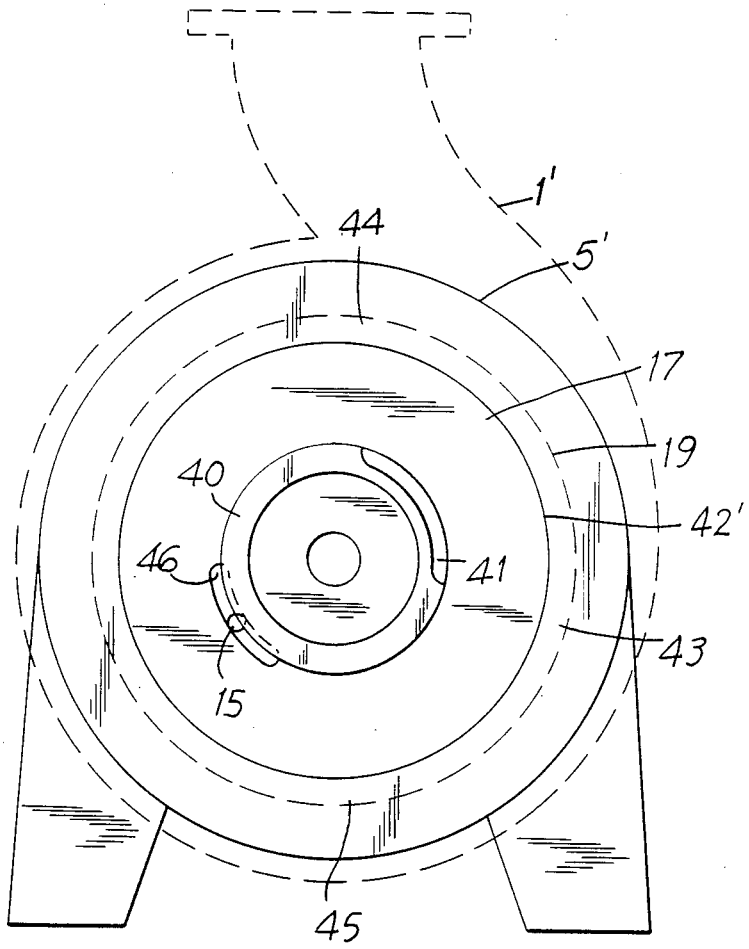
FIGS. 4*a* and *b* show still another embodiment of the present invention.
Figure 4B:
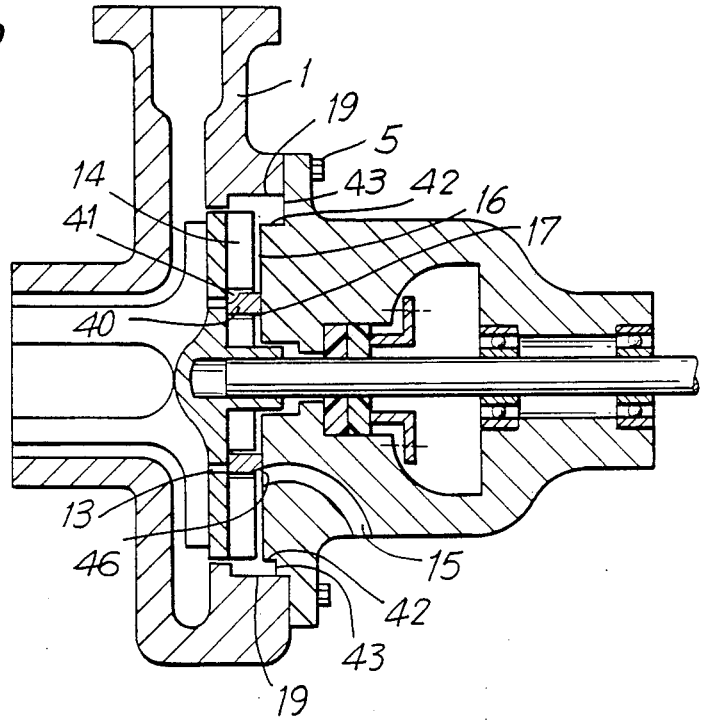

Still another embodiment is shown in FIG. 4. The operation of said embodiment is similar to the embodiments described earlier. FIG. 4*a* is a plan view of the pump back wall 17 in such a way that the volute of the centrifugal pump is shown in dotted lines 1'. FIG. 4*b* is a sectional side view of the pump structure in accordance with this embodiment. The frame structure of the pump is illustrated by line 5', and the dotted line 19 (in FIG. 4*a*) illustrates the inner peripheral surface of the vacuum pump housing 18. As can be seen, line 19 is coaxial with the pump axis and thus in connection with this embodiment the "eccentricity" explained above is present as follows. The inner circle 42' is formed by the edge of surface 42 of a groove formed by the surfaces 42 and 19 together with the bottom plane 43. The bottom plane 43 is slightly inclined with respect to the radial direction thereof in such a way that the axial dimension of surface 19 has a maximum near the outlet opening of the pump (see reference numeral 44) and a minimum at the opposite side thereof (see reference numeral 45). The difference to other embodiments detailed herein earlier can be seen in the space behind the centrifugal impeller and more specifically in the back wall 17 of the pump which has been provided with substantially ring shaped stationary protrusion 40 which serves as closing means for directing the gas/medium flow as is more fully explained below. Annual protrusion or closing means 40 is located at the same distance from the pump axis as are the gas discharge openings 13 in the impeller back plate 11. The radial dimension of the closing means is larger than that of the impeller openings 13 so that the closing means is able to sufficiently block the flow path from the front side of the impeller to the chamber 16. The closing means extends also from the back wall 17 in close proximity to the impeller back plate 11 to ensure the blocking of the impeller openings 13. A longitudinal recess 41 is provided in the outer edge, that is the edge closer to or facing the impeller, of the closing means 40 for permitting a connection between the openings 13 in the impeller back plate 11 and the chamber 16 and the areas between the back vane 14 of the impeller. The recess 41 is located at the circumference of the closing means 40 in such a way that when in operation, the liquid ring is moving outwards thereby creating a vacuum and drawing the gas from the impeller front side. The length of said longitudinal recess 41 may extend over one or several openings 13 of the impeller back plate 11. Preferably, the length of recess 41 is equal to about a quarter of the circumference of the closing means 40. This, of course, depends largely on the number of openings 13 in the impeller and also on the operational conditions of the centrifugal pump itself. At the pump back wall end of the closing means there is provided another recess 46 at a location so that when in operation the liquid ring of the vacuum pump is moved toward the pump axis, the gas is forced out of the areas formed between the back vanes 14. Recess 46 in the closing means 40 is located so that there is a connection between the chamber 16 and the gas discharge channel 15 in the pump frame structure 5. The discharge channel 15 may be formed by a single bore through the pump frame structure 5 or by a larger space so that the recess/opening 46 leading to the space is able to connect several areas between the back vanes 14 to the space in the frame structure 5. Required as a precondition for the proper operation of the described structure are small clearances between the moving impeller back vanes 14 and the back wall 17 of the pump and also between the impeller back plate 11 and the closing means 40. It is noted that the back vanes 14 of the impeller are quite short as they extend from the proximity of the closing means 40 outwards to the outer edge of the impeller back plate 11. The number of the back vanes 14 may be greater than in previous embodiments as the sealing between the back vanes 14 and the closing means 40 is more effective the greater the number of vanes is. The simplest embodiment of the closing means 40 is to arrange the same as a ring-shaped member as an integral part of the back wall 17 of the pump, whereby the recesses 41 and 46 may be machined later or could also be prepared during the manufacturing of the pump frame structure 5. Another way is to manufacture the closing means 40 separately and then attach said means for instance by bolts or screws to the back wall 17 of the pump. The former embodiment does not permit adjusting the angular position of the closing means 40 with respect to different kinds of operating conditions of the pump. The later embodiment renders the manufacture of the pump more complicated due to the greater number of pump components, but provides the possibility of adjusting the angular position of the respective recesses of the closing means 40.

Figure 5B:
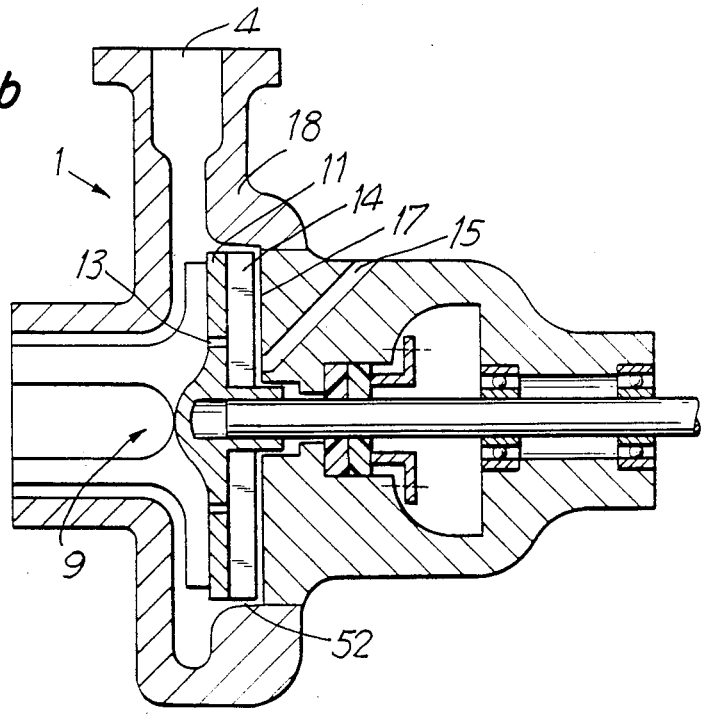
FIGS. 5*a* and *b* show yet another embodiment of the present invention.
Figure 5A:
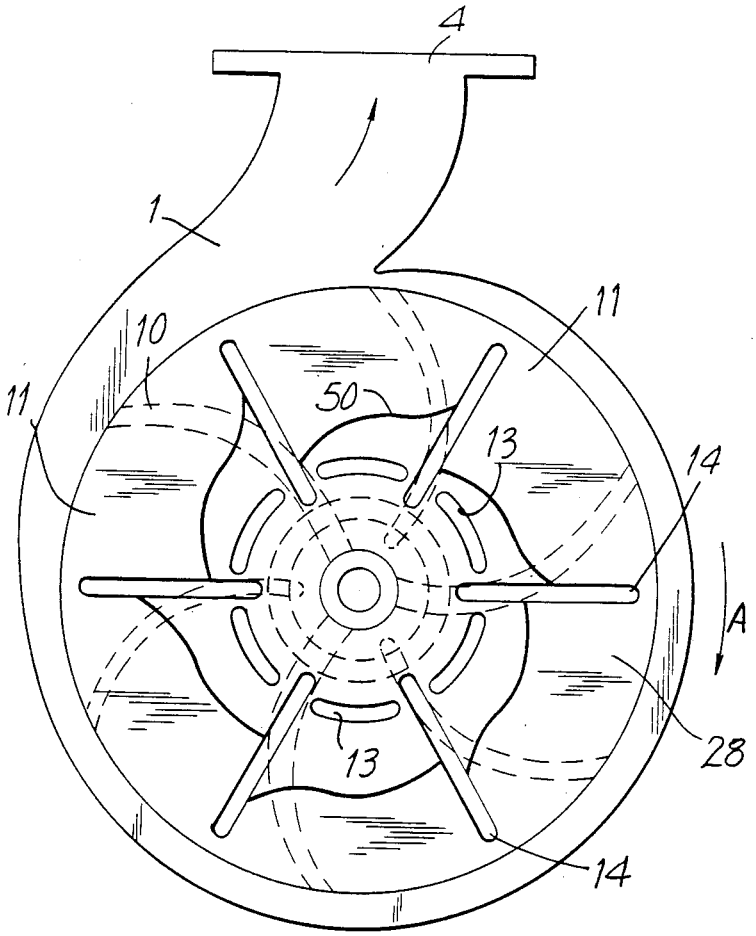

Still another embodiment for discharging gas from a space behind the pump impeller is illustrated in FIGS. 5*a* and 5*b*. This embodiment utilizes the fact that the pressure distribution in the volute of a centrifugal pump is typically unequal in such a way that the highest pressure is found in the vicinity of the outlet opening 4 while the pressure is decreasing in the direction of the rotation of the impeller 9 in such a way that the lowest pressure is encountered essentially opposite the outlet opening 4. FIG. 5*a*, illustrating the back side of the impeller 9 in operating condition, shows how the pressure distribution changes in the volute of a test apparatus where the back wall of the pump was made of transparent material. In FIG. 5*a* the liquid boundary lines between the gas and the medium are indicated with numeral 50. As can be seen, the amount of liquid in the spaces 28 between the back vanes 14 of the impeller is proportional to the pressure, i.e. the more liquid is present in a particular space the higher the pressure in the volute. This pressure distribution may be utilized in such a way that while the pressure is at its lowest the gas from the front side of the impeller 9 flows through the impeller openings 13 to the spaces 28 between the back vanes 14. Tests have shown that the liquid in these spaces behind the impeller 9 tends to move outwards in spite of the fact that the pump housing 18 behind the impeller 9 is substantially circular. This phenomenon results in some of the liquid leaking from the back side of the impeller 9 back to the volute in front of the impeller 9. This kind of leakage is possible if the clearance between the impeller back plate 11 and the surrounding impeller housing 18 is sufficiently wide (indicated at 52 in FIG. 5*b*). While the pressure is increasing, the liquid in the spaces between the back vanes 14 is moving towards the pump axis i.e. liquid is passing from the volute to the back side of the impeller 9 thus forcing the gas out of the space. If the pump back wall 17 is at this location provided with an opening 15, as shown in FIG. 5*b*, the gas will flow through said opening and through the channel 15 and away from the pump. Thus the operation of this embodiment is quite similar to the first embodiments of this specification as the liquid moving in the spaces 28 between the back vanes 14 of the impeller 9 may block the openings 13 in the impeller 9 and thus prevent the gas from escaping to the front side of the impeller 9. Sometimes the pressure at the front side of the impeller 9 may be higher than the pressure at the gas discharge channel 15 so that the gas would flow to said channel 15 but not to the front side of the impeller 9. However, it is noted that the gas discharge ability of this embodiment is not as good as in the previous embodiments as the pressure difference obtained by the unequal pressure distribution of the volute is quite low.

The liquid ring discussed above may be formed of the material to be pumped, for instance a fiber suspension. However, it may also be formed of a mixture of the material to be pumped and another liquid supplied from the outside to the pump directly or through filtering means within the pump. The excess liquid is mainly used for diluting the material to be pumped and to facilitate the operation of the liquid ring pump. Further, the liquid ring may also be entirely formed of liquid introduced from outside the pump or it may be the liquid filtered from the material to be pumped.

Finally, it should be recalled that the above description discloses only some preferred embodiments of the pumping apparatus according to the present invention, the protective scope whereof is not limited to the above but to what is set forth in the accompanying claims. Furthermore, it is noted that even though the specification is directed mainly to pumps for pumping pulp or fiber suspensions the scope of the present invention includes other pumping applications where air/gas removal from a medium to be pumped is preferable and/or necessary.

What is claimed is:

1. A centrifugal pump for separating an entrained gas from a working fluid comprising A. a housing having a hollow chamber therein, an axially extending inlet into said chamber, an outlet leading out of said chamber, and a gas vent for said chamber, B. a rotatable shaft mounted in said housing in axial alignment with said inlet, C. an impeller disposed in said chamber and mounted on said shaft for rotation therewith, said impeller including i. a rotatable plate for dividing said chamber into a first chamber portion communicating with said inlet and outlet and a second chamber portion forming means for generating a pressure difference and directly communicating with said vent, said plate having an aperture extending therethrough for allowing the passage of working fluid and gas therethrough;

ii. at least one pumping vane disposed in said first chamber portion for pumping said working fluid into said first chamber portion through said inlet and out of said first chamber portion through said outlet; and iii. means for partitioning said second chamber portion into a plurality of spaces, said partitioning means comprising a plurality of back vanes secured to said plate and a liquid ring rotatable within said second chamber portion upon said impeller rotating so as to create said pressure difference in said spaces for removing gas in said second chamber portion directly through said vent.

2. The pump of claim 1, wherein said liquid rotatable within said second chamber portion is the working fluid.

3. The pump of claim 2, wherein said plurality of spaces in said second chamber portion are substantially wedge shaped and circumferentially arranged.

4. The pump of claim 1, additionally comprising at least one fluidizing blade mounted on said impeller within said first chamber portion for fluidizing said working fluid to be pumped.

5. The pump of claim 1, wherein said working fluid is a gas-containing fiber suspension.

6. The pump of claim 5, wherein said liquid rotating in said second chamber portion comprises said fiber suspension.

7. The pump of claim 1, wherein said means for partitioning said second chamber portion additionally comprises an impeller hub portion surrounding said pump shaft and extending from said plate of said impeller substantially axially at least up to the distance defined by the axial dimension of said back vanes of said impeller; said back vanes extending outwardly from said hub portion.

8. The pump of claim 1, additionally comprising a back wall defining said second chamber portion opposite said plate and wherein said means for partitioning said second chamber portion comprises an annular protrusion extending from said back wall of said pump towards said back plate of said impeller so that the clearance between said annular protrusion and said impeller plate prevents leakage of pressure therethrough.

9. The pump of claim 8, wherein said protrusion extends in a substantially axial direction from said back wall of said second chamber and at the same radial distance from said pump axis as said aperture through said impeller plate such that said protrusion blocks the flow path from said first chamber portion to said second chamber portion behind said impeller, except at such angular position at which said protrusion comprises a recess facing said impeller back plate for permitting said flow to pass from said first chamber portion to said second chamber portion; said protrusion also blocking the flow path from said second chamber portion to said gas vent except at such angular position at which said protrusion comprises a recess facing said back wall for permitting said gas to pass from said second chamber portion to said gas vent.

10. The pump of claim 1, wherein said second chamber portion further comprises an annular flange portion for separating said second chamber portion from said first chamber portion and an inner peripheral surface, said flange portion extending from said inner peripheral surface towards said shaft and said plate, said flange portion, said inner peripheral surface and said back wall forming a substantially annular channel.

11. The pump of claim 1, wherein said second chamber portion further comprises an annular flange portion for separating said second chamber portion from said first housing portion and substantially axial eccentric inner peripheral surface, said flange portion extending from said eccentric inner surface toward said shaft and said plate; said flange portion, said eccentric inner peripheral surface and said back wall forming a substantially annular channel.

12. The pump of claim 10, wherein said substantially annular channel is formed by said flange portion, said inner surface of said second chamber portion and a portion of said back wall, said back wall portion being inclined with respect to the radial direction thereof such that the axial dimension of said inner peripheral surface of said second chamber portion is the smallest at the point of location of said gas vent.

13. The pump of claim 1, wherein said second chamber portion comprises a annular flange portion for separating said second chamber portion from said first chamber portion and a substantially axial eccentric inner peripheral surface, said flange portion extending from said eccentric inner surface towards said shaft and said plate, said flange portion, said eccentric inner surface and said back wall forming a substantially annular channel.

14. The pump of claim 10, wherein said gas vent comprises an opening in the vicinity of said shaft.

15. The pump of claim 14, wherein said gas vent further comprises a duct connected to said opening.

16. The pump of claim 10, wherein said second chamber portion together with said back vanes of said impeller form a vacuum pump for removing gas from the front side of said impeller through said aperture in said impeller plate to said second chamber portion and for further discharging said gas through said gas vent.

17. The pump of claim 10, wherein said flange portion of said second chamber portion has an opening therein for allowing said working liquid rotating along said inner peripheral surface of said second chamber portion in said substantially annular channel to flow back into said first chamber portion, said opening being located so that the distance between said second chamber portion inner peripheral wall and said pump axis is the largest near said opening.

18. The pump of claim 1, wherein said back vanes of said impeller plate are arranged such that the clearance between the outer edges of said back vanes and said housing of the pump is sufficiently small so that substantially no leakage occurs therethrough, and that the clearance between the periphery of said impeller plate and said pump housing is such that the pumped fluid is able to substantially freely leak therethrough back and forth depending on the pressure fluctuations in said housing, whereby said fluctuations cause a vacuum or pumping effect on the liquid present behind said impeller.

19. The pump of claim 18, wherein said gas vent is in communication with a duct for allowing the discharge of said gas flow from behind said impeller plate out of said pump.

20. The pump of claim 14, wherein said distance between said aperture in said impeller plate and said pump axis is larger than the distance between said gas vent and said pump axis.

21. A centrifugal pump for separating gas from a gas containing fiber suspension to be pumped comprising:

a first chamber portion having a suspension inlet and a suspension outlet;

a shaft mounted rotatably coaxially with said inlet;

a centrifugal impeller mounted on said shaft, said impeller comprising at least one pumping vane, at least one fluidizing blade, a back plate having at least one aperture therethrough, and a plurality of back vanes mounted on said back plate, said pumping vane being mounted on said backplate at the side of said inlet and said back vanes being mounted on said backplate at the opposite side thereof;

a second chamber portion surrounding said back vanes of said impeller and forming a chamber behind said impeller, said second chamber portion including means for discharging gas introduced into said chamber through said aperture in said impeller backplate.

22. A centrifugal pump for separating gas from a gas containing high consistency fiber suspension comprising:

a first housing portion having a suspension inlet for receiving the suspension to be pumped and a suspension outlet for discharging the suspension being pumped;

a shaft mounted rotatably coaxially with said inlet;

a centrifugal impeller mounted on said shaft, said impeller including at least one pumping vane, at least one fluidizing blade for fluidizing said high consistency fiber suspension, a backplate, said backplate having at least one aperture therethrough for permitting separated gas and suspension to pass therethrough, and a plurality of back vanes, said pumping vane being mounted to said backplate at the inlet side and back vanes being mounted on the opposite side thereof;

a second housing portion surrounding said back vanes of said impeller and forming a liquid ring pumping chamber behind said impeller, said second housing portion including means for directly discharging said gas introduced into said chamber through said aperture in said impeller out of said pump.

* * * * *